US010807834B2

(12) United States Patent
Friessen

(10) Patent No.: US 10,807,834 B2
(45) Date of Patent: Oct. 20, 2020

(54) QUICK RELEASE WEIGHT RETAINING DEVICE

(71) Applicant: Andrew Friessen, Riverside, IA (US)

(72) Inventor: Andrew Friessen, Riverside, IA (US)

( * ) Notice: Subject to any disclaimer, the term of this patent is extended or adjusted under 35 U.S.C. 154(b) by 0 days.

(21) Appl. No.: 16/558,257

(22) Filed: Sep. 2, 2019

(65) Prior Publication Data

US 2020/0087119 A1 Mar. 19, 2020

Related U.S. Application Data

(60) Provisional application No. 62/731,201, filed on Sep. 14, 2018.

(51) Int. Cl.
*B66C 1/26* (2006.01)

(52) U.S. Cl.
CPC ..... *B66C 1/26* (2013.01)

(58) Field of Classification Search
CPC ..... B66C 1/26; B66C 1/34; F16B 45/00
USPC ..... 294/82.31, 82.1, 82.17, 82.19; 59/93
See application file for complete search history.

(56) References Cited

U.S. PATENT DOCUMENTS 4,148,514 A * 4/1979 McCullough ..... B66C 1/34 294/82.34
4,618,179 A * 10/1986 Mampaeij ..... B66C 1/40 294/82.31
4,693,097 A * 9/1987 Rivera ..... E05B 67/38 24/116 R
4,911,394 A * 3/1990 Ericson ..... B66C 1/34 248/301
6,241,298 B1 * 6/2001 Whyte ..... B66C 1/34 294/82.36
6,968,600 B2 * 11/2005 Marcaccio ..... B64D 1/22 24/129 R
2004/0066051 A1 * 4/2004 Serpas ..... B66C 1/34 294/82.1

* cited by examiner

*Primary Examiner* — Paul T Chin
(74) *Attorney, Agent, or Firm* — Patentfile, LLC; Bradley C. Fach; Steven R. Kick

(57) ABSTRACT

A quick release weight retaining device may include a grapple which may be removably engaged to a retainer. The grapple may include a seat and an ejector, and the retainer may include an arm. The grapple may be coupled to objects, such as a lifting bar, preferably via a securement fastener. The retainer may be coupled to objects, such as weight plates and the like, via a retainer body and a weight saddle. The arm may rest in the seat and be maintained therein by a desired weight, such as the weight of the weight saddle. When the weight is relieved from the retainer, such as by the weight saddle resting on a ground surface, the ejector may force the arm out of the seat thereby disengaging the grapple and retainer.

20 Claims, 8 Drawing Sheets

QUICK RELEASE WEIGHT RETAINING DEVICE

CROSS REFERENCE TO RELATED APPLICATIONS

This application claims priority to and the benefit of the filing date of U.S. Provisional Application No. 62/731,201, filed on Sep. 14, 2018, entitled "QUICK RELEASE WEIGHT RETAINING DEVICE", which is hereby incorporated by reference in its entirety.

FIELD OF THE INVENTION

This patent specification relates to the field of devices which are configured to both secure and release objects. More specifically, this patent specification relates to a device configured to secure objects, such as weights, while allowing the objects to be quickly released when needed.

BACKGROUND

Devices with the ability to both secure objects and to quickly release those objects when needed have many applications. Of particular importance is weight lifting and training applications. Users in this field often lift large amounts of weights but also need to be able to quickly release the weights to prevent injury such as when lifting to fatigue. For example, weight releaser devices exist for users to perform squatting exercises. These devices typically have a hook for engaging a weight lifting bar, a body for holding and receiving weights, such as weight plates, and a floor contacting member with an angled surface. The user may perform squats and when desired the user may lower the device until the angled surface contacts the floor the hook is moved off and away from the bar thereby releasing the user from the device and weight. However, these devices suffer from numerous drawbacks as they tend to be large and bulky so as to be difficult to set up and reset if the user is working out alone or without a partner. They also tend to be heavy so that their weight needs to be considered by the lifting user which may limit the user's ability to perform a desired exercise at a desired weight. Additionally, the angled portion of current weight releaser devices cause the weight releaser devices to jerk the bar if the bar is not rapidly lowered.

Therefore, a need exists for novel devices configured to secure objects, such as weights, while allowing the objects to be quickly released when needed. There is also a need for novel devices which are configured to both secure and release objects that are not large and bulky so as to be difficult to set up and reset if the user is working out alone or without a partner. A further need exists for novel devices which are configured to both secure and release objects that are lightweight so as not to unnecessarily limit the user's ability to perform a desired exercise at a desired weight.

BRIEF SUMMARY OF THE INVENTION

A quick release weight retaining device is provided which provides many benefits over existing weight releaser devices. The device is configured to secure objects, such as weights, while allowing the objects to be quickly released when needed. The device acts over a shorter range of motion than current weight releasers, allowing for a greater range of motion by the user. Additionally, the device does not jerk the bar if the bar is not rapidly lowered as is a common occurrence with current weight releasers due to their angled portions.

In some embodiments, the device may include a grapple which may be removably engaged to a retainer. The grapple may have a seat and an ejector. The seat may be positioned between a front tooth and a rear wall, and the front tooth may extend above the seat. The ejector may have an ejector surface, and the ejector surface may be movable between a first position and a second position. The retainer may include an arm which is configured to rest on the seat when the ejector surface is in the first position, and the arm may be lifted above the front tooth when the ejector surface is in the second position so that the arm may be easily separated from the grapple. The grapple may be coupled to objects, such as a lifting bar, preferably via a securement fastener. The retainer may be coupled to objects, such as weight plates and the like, via a retainer body and a weight saddle. The arm may rest in the seat and be maintained therein by a desired weight, such as the weight of the weight saddle. When the weight is relieved from the retainer, such as by the weight saddle resting on a ground surface, the ejector may force the arm out of the seat thereby disengaging the grapple and retainer.

In further embodiments, the grapple may include a catch which may be configured to prevent the ejector surface from moving into the second position. Optionally, the catch may include an arm depression which may receive portions of the arm.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Figure 1:
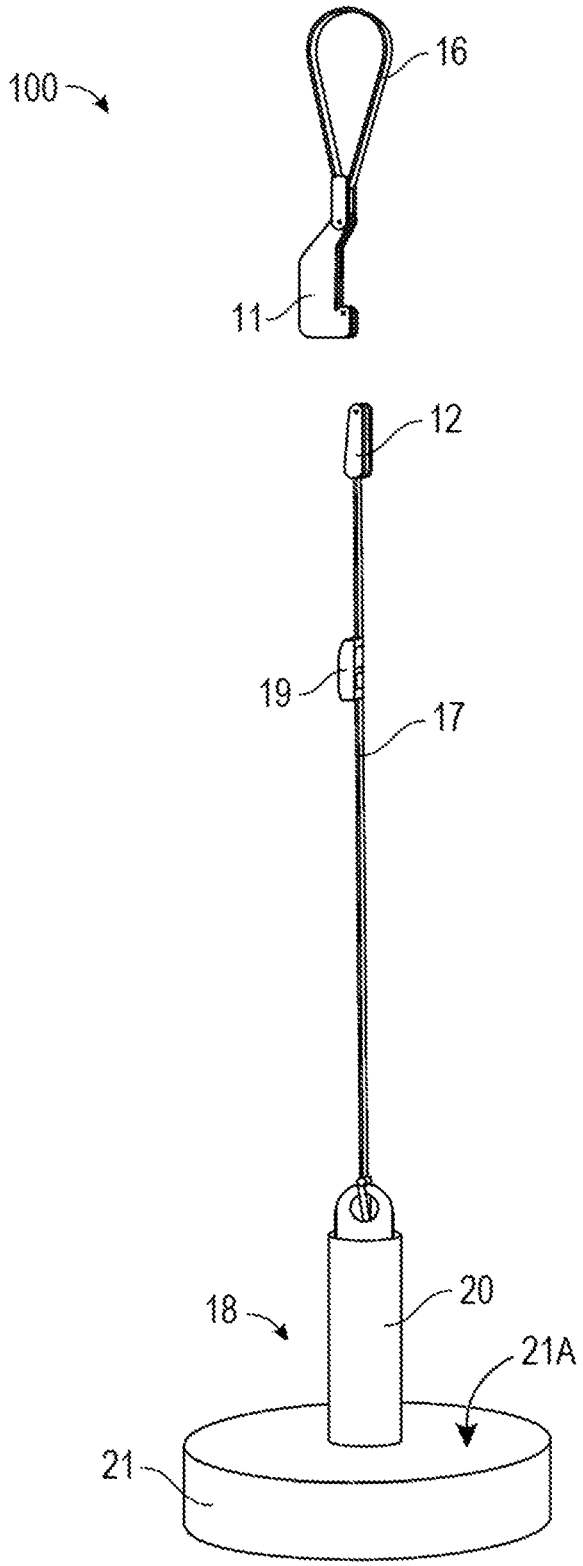
FIG. 1 depicts a perspective view of an example of a quick release weight retaining device according to various embodiments described herein.
Figure 2:
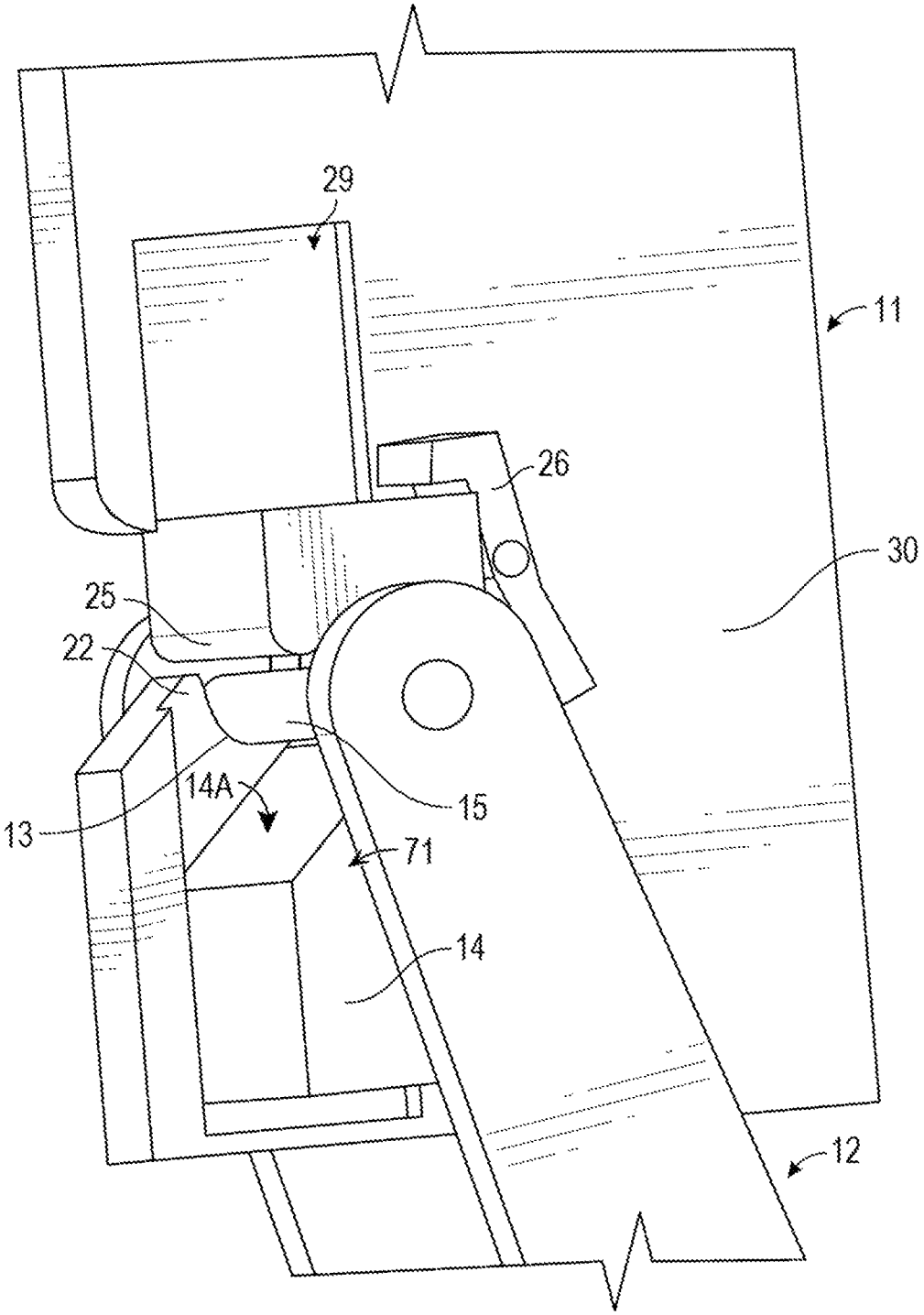
FIG. 2 illustrates a front perspective internal view of an example of a grapple engaged to an arm of a retainer according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts of the invention. Hence, specific dimensions and other physical characteristics relating to the embodiments disclosed herein are not to be considered as limiting, unless expressly stated otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

A new device configured to secure objects, such as weights, while allowing the objects to be quickly released is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-4, and 8 illustrate examples of a quick release weight retaining device ("the device") 100 according to various embodiments. In some embodiments, the device 100 may comprise a grapple 11 which may be removably engaged to a retainer 12. The grapple 11 may include a seat 13 and an ejector 14, and the retainer 12 may include an arm 15. The grapple 11 may be coupled to objects, such as a lifting bar, preferably via a securement fastener 16 and/or a grapple aperture 32. The retainer 12 may be coupled to objects, such as weight plates and the like, via a retainer body 17 and a weight saddle 18. The arm 15 may rest in the seat 13 and be maintained therein by the weight of the weight saddle 18. When the weight of the weight saddle 18 is relieved from the retainer 12, such as by the weight saddle 18 resting on a ground surface, the ejector 14 may force the arm 15 out of the seat 13 thereby disengaging the grapple 11 and the retainer 12. The device 100 can be used alone or in pairs. Examples of alone use includes weighted dips, then as the user fatigues, the user drops the weight which can be done the same for other exercises such as weighted pull-ups.

As perhaps best shown in FIG. 1, in some embodiments, the device 100 may comprise a retainer 12 which may be removably coupled to objects, such as weight plates. Optionally, the device 100 may comprise a weight saddle 18 which may be coupled to the retainer 12 via a retainer body 17. A retainer body 17 may be made from any material which may be suitable for supporting a desired amount of weight or object. In preferred embodiments, a retainer body 17 may be made from or comprise a flexible material so that the retainer body 17 may be able to bend or flex, such as nylon webbing, rope, chain, flexible rubber, flexible plastic, or any other material which may be able to bend or flex. In other embodiments, a retainer body 17 may be made from or comprise a substantially material so that the retainer body 17 may resist bending or flexing, such as metal pipe, conduit, bar stock, or the like, or any other material which may be substantially rigid in shape so as to resist bending or flexing.

In some embodiments, a retainer body 17 may be adjustable in length so that the distance between the retainer 12 and a weight saddle 18 may be changed. Optionally, the device 100 may comprise one or more length adjusters 19 which may comprise a fastener or coupling method which may enable the retainer body 17 to be adjustable in length. For example, the retainer body 17 may be made with or comprise one or more lengths of nylon webbing and a length adjuster 19 may comprise a cam buckle or other webbing fastener which may be configured to adjust the length of the retainer body 17.

In some embodiments, the device 100 may comprise a weight saddle 18 which may be configured to receive and support objects such as weight plates. Preferably, a weight saddle 18 may comprise a sleeve 20 and a foot 21, and the sleeve 20 may be coupled to a foot support surface 21A of the foot 21. Generally, the sleeve 20 may be inserted through the central aperture of a weight plate to rest against one or more foot support surfaces 21A the foot 21 to allow the weight saddle 18 to support one or more weight plates. The sleeve 20 may be configured in any shape and size, such as to be able to be inserted into the central aperture of a weight plates having a diameter typically between 25 to 50 millimeters as is common to "standard" plates and "Olympic" plates, respectively. Similarly, a foot 21 and its one or more foot support surfaces 21A may be configured in any shape and size, and preferably a larger shape and size than the sleeve 20 so that the foot 21 and its one or more foot support surfaces 21A may prevent a weight, such as a weight plate, from falling off the bottom of the sleeve 20. A weight saddle 18 may be configured in any other shape and size and made from any material suitable for supporting one or more weight plates of any weight, size, or shape.

Figure 6:
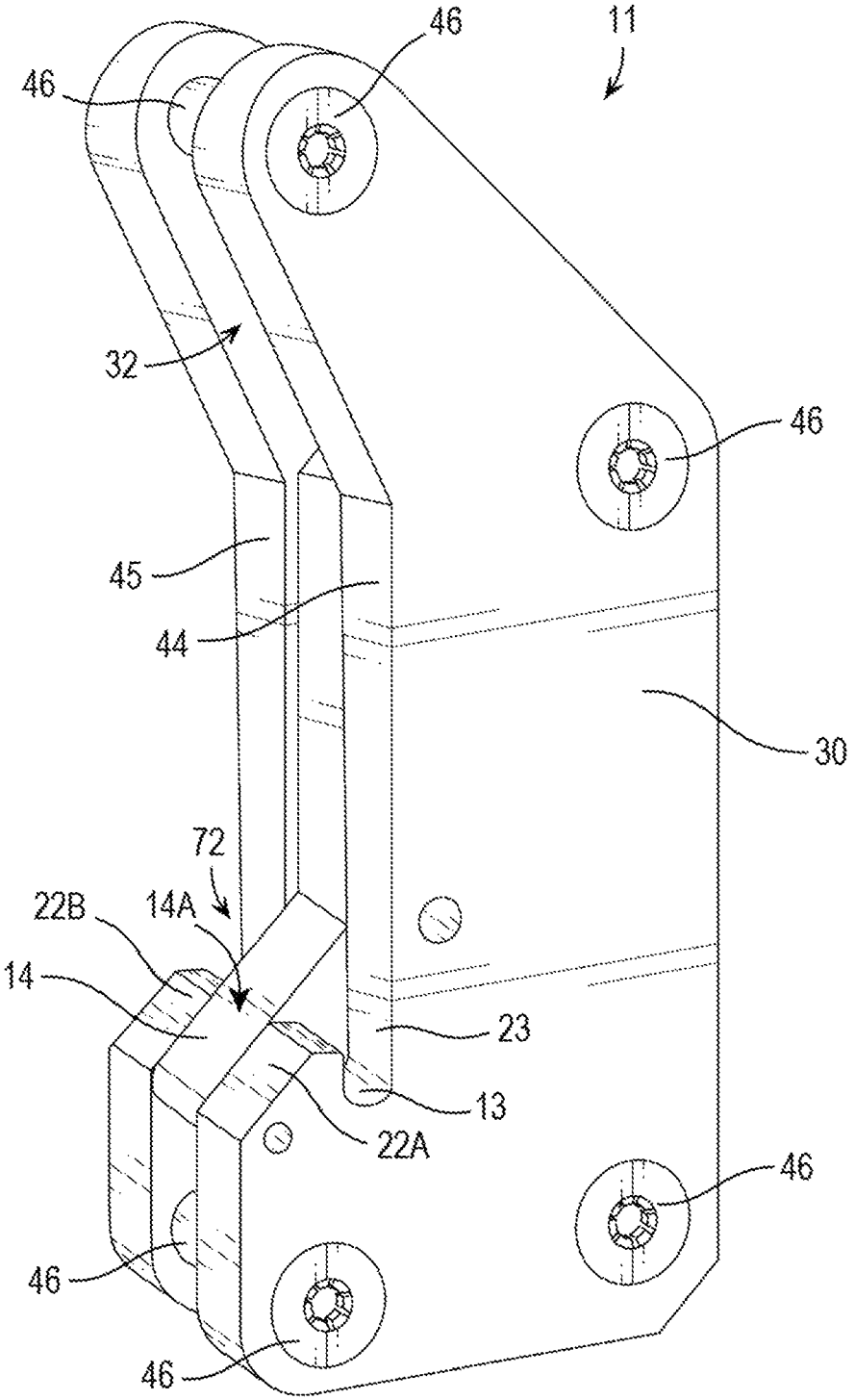
FIG. 6 shows a front perspective view of another example of a grapple according to various embodiments described herein.
Figure 7:
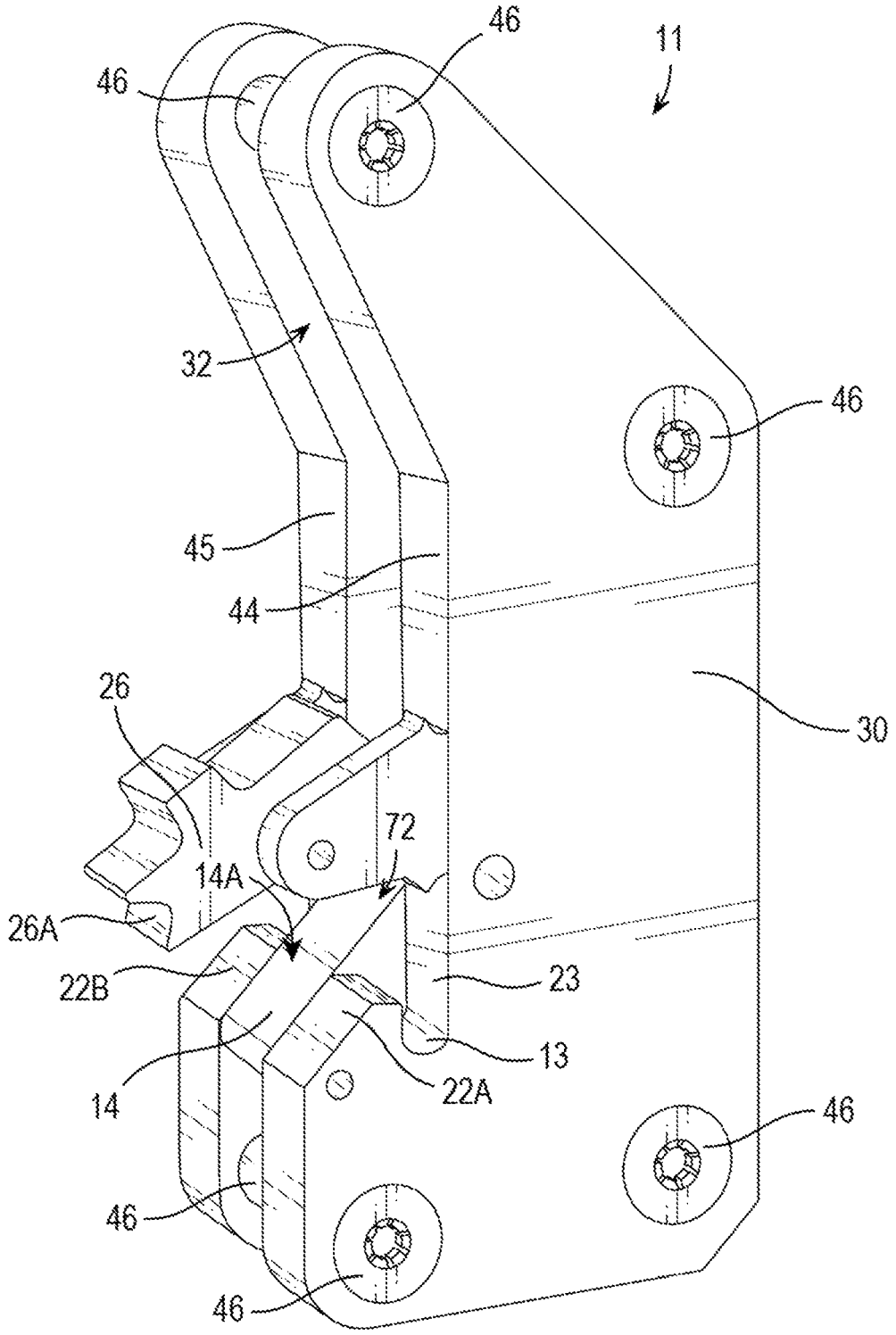
FIG. 7 depicts a front perspective view of yet another example of a grapple according to various embodiments described herein.
Figure 8:
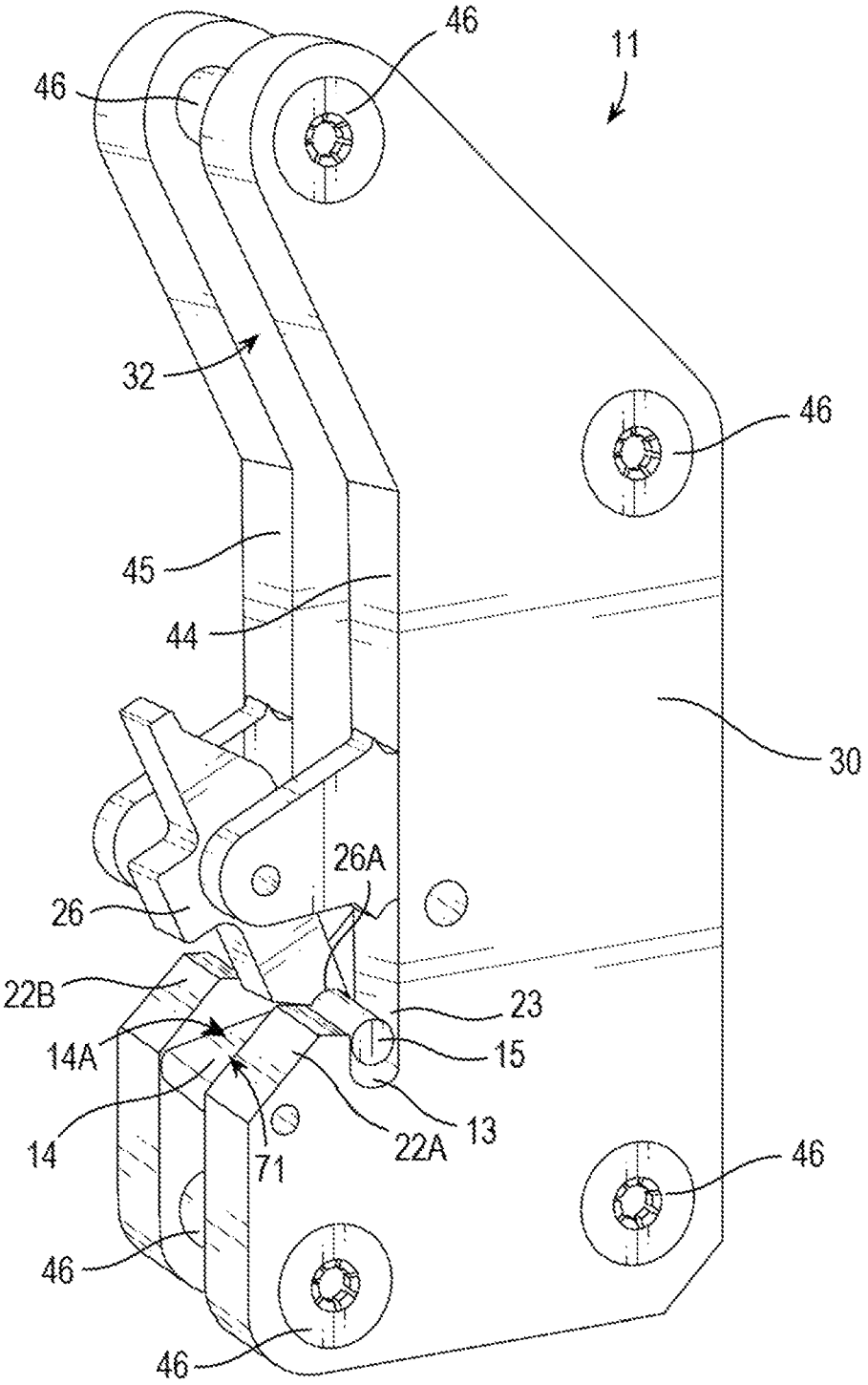
FIG. 8 depicts a front perspective view the example grapple of FIG. 7 with an arm of a retainer resting on the seat and with a catch maintaining the ejector in the first position according to various embodiments described herein.

The device 100 may comprise one or more grapples 11 which may be removably engaged to one or more retainers 12. A grapple 11 may comprise a grapple body 30 to which and/or into which one or more elements of the grapple 11 may be coupled and/or formed. A grapple body 30 may be made of or may comprise durable materials such as steel, aluminum, and other metals, which may be suitable for supporting weights that may be used for physical fitness training. In some embodiments, and as shown in FIGS. 6-8, a grapple body 30 may be formed by a first plate 44 and a second plate 45 which may be coupled together via one or more grapple fasteners 46, such as rivets, screws, bolts, other threaded fasteners, etc., heat bonding, or any other coupling method. In further preferred embodiments, and as shown in FIGS. 6-8, an ejector 14 may be pivotally coupled between a first plate 44 and a second plate 45.

In preferred embodiments, a grapple 11 may comprise one or more seats 13 which may be sized and shaped to receive portions of an arm 15 of a retainer 12. Generally, a seat 13 may comprise a depression in the structure of the grapple 11, such as in the grapple body 30, that is sized and shaped to receive portions of an arm 15 of a retainer 12. A seat 13 may be configured in any size and shape which may allow portions of an arm 15 to rest on or be supported by the seat 13.

A grapple 11 may comprise one or more front teeth 22, such as a first front tooth 22A and a second front tooth 22B. Generally, a front tooth 22 may comprise a protrusion or other structure which may extend above a seat 13. Preferably, each seat 13 may be positioned between a front tooth 22 and all or portions of a rear wall 23 so that the front tooth 22 and rear wall 23 may bound opposing ends of the seat 13 depression. The rear wall 23 may prevent the portions of an arm 15 of a retainer 12 from exiting the seat 13 in a direction away from a front tooth 22, while the front tooth 22 may extend above the seat 13 so that portions of an arm 15 of a retainer 12 must be lifted over the front tooth 22 in order to enter and exit the seat 13. For example, the front tooth 22, seat 13, and rear wall 23 may generally resemble a hook shape (hook being a tool consisting of a length of material, typically metal, that contains a portion that is curved or indented, such that it can be used to grab onto, connect, or otherwise attach itself onto another object). The hook shape formed by the front tooth 22, seat 13, and rear wall 23 may be suitable for receiving portions of an arm 15 of a retainer 12 and for supporting the retainer body 17, weight saddle 18, and any weight plate(s) resting thereon. Optionally, a grapple 11 may comprise two or more front teeth 22, seats 13, and/or rear walls 23 which may be configured to receive portions of a single arm 15 of a retainer 12. In further preferred embodiments, and as shown in FIGS. 6-8, a grapple 11 may comprise a first plate 44 and a second plate 45 with a first front tooth 22A, a first seat 13, and a first rear wall 23 formed into the first plate 44, and a second front tooth 22B, a second seat 13, and a second rear wall 23 formed into the second plate 45 with an ejector 14 movably coupled between the first plate 44 and a second plate 45.

In some embodiments, a grapple 11 may comprise one or more ejectors 14 which may be configured to displace or eject the arm 15 of a retainer 12 from the seat 13. An ejector 14 may comprise an ejector surface 14A which may be moved between a first position 71 and a second position 72. Optionally, an entire ejector 14 and therefore its ejector surface(s) 14A may be moved between a first position 71 and a second position 72.

In preferred embodiments, a grapple 11 may comprise one or more ejectors 14 having an ejector surface 14A which may be configured to displace or eject the arm 15 of a retainer 12 from the seat 13 when the weight acting on the retainer 12 falls below a threshold, such as when the weight saddle 18 is resting on a ground surface. In further embodiments, an ejector 14 and/or its ejector surface 14A may be moved between a first position 71 and a second position 72. In preferred embodiments, a grapple 11 may comprise a first front tooth 22A and a second front tooth 22B, and an ejector 14 may be movably coupled between the teeth 22A, 22B, so that the ejector 14 and its ejector surface 14A is movable between the teeth 22A, 22B, between the first 71 and second 72 positions. When in the first position 71, the ejector 14 may not interfere with the positioning of the arm 15 when the arm 15 is resting on the seat 13. When in the second position 72, the arm 15 may be prevented from resting on the seat 13. In further embodiments, an arm 15 may be configured to rest on the seat 13 when the ejector surface 14A is in the first position 71, and the arm 15 may be lifted above a front tooth 22 when the ejector surface 14A is in the second position 72 so that the front tooth 22 may not prevent the arm 15 from separating from the grapple 11. In some embodiments and referring to the example of FIGS. 2 and 3, the ejector 14 may move generally linearly between the first 71 and second 72 positions. Optionally, the movement of an ejector 14 may be directed by a channel 29 that may be formed into the grapple 11 such as into the grapple body 30. When the ejector 14 moves into the second position 72, the ejector may lift the arm 15 above the front tooth 22 to allow the arm 15 to slide out of the grapple 11. In other embodiments and referring to the example of FIG. 4, the ejector 14 may be rotated between the first 71 and second 72 positions. When the ejector 14 rotates into the second position 72, the ejector may lift the arm 15 above the front tooth 22 and push the arm 15 away from the seat 13 to allow the arm 15 to fall out of the grapple 11.

In some embodiments, an ejector 14 may comprise an arrestor 25. Preferably, an arrestor 25 may comprise a protrusion that may extend towards the seat 13 and/or front tooth 22 so that when the ejector 14 is in the first position 71, the arrestor 25 may prevent an arm 15 from entering or exiting the seat 13. In this manner, an arm 15 may be engaged in the seat 13 (to removably engage or couple the grapple 11 to the retainer 12) by placing the arm 15 in contact with the ejector 14 while it is in the second position 72 and then pressing the arm 15 down towards the seat 13 thereby pressing the ejector 14 down into the first position 71 so that the arrestor 25 may prevent the arm 15 from exiting the seat 13.

In preferred embodiments, the grapple 11 may comprise a tensioner 24 which may motivate the ejector 14 from the first position 71 to the second position 72 so that the ejector 14 may be tensioned into or towards the second position 72. In some embodiments, a tensioner 24 may comprise a spring, such as a coil spring, which is an elastic object used to store mechanical energy and which may be made from out of spring steel, annealed steel which is hardened after fabrication, and non-ferrous metals including phosphor bronze, titanium, beryllium copper, or any other suitable material. In other embodiments, a tensioner 24 may comprise any type of spring such as a Tension/extension spring, Compression spring, Constant-force spring, Torsion spring, Variable spring, Coil spring, Flat spring, Machined spring, Serpentine spring, Cantilever spring, Hairspring or balance spring, Leaf spring, V-spring, Belleville washer or Belleville spring, Gas spring or gas piston, Mainspring, Negator spring, Progressive rate coil springs, Spring washer, Torsion spring, Wave spring, Rubber band, bungee cord, or other non-metallic elastic material, or any other material or device which is suitable for tensioning an ejector 14 towards and into the second position 72.

In preferred embodiments, the weight of the retainer 12 and the retainer body 17 may not be sufficient to overpower the tensioner 24 to maintain the ejector 14 in the first position 71. In further preferred embodiments, weight exceeding the weight of the retainer 12 and the retainer body 17 may be sufficient to overpower the tensioner 24 to maintain the ejector 14 in the first position 71. In still further embodiments, the tensioner 24 may be configured to provide tension that is powerful enough to offset the weight of the retainer 12 and retainer body 17 (rigging), and each may be adjusted for the desired working weight range of the device 100. For heavier retainer body 17, such as comprising a chain instead of nylon webbing, the tensioner 24 size may be changed to accommodate the extra "tare" weight.

In some embodiments, the device 100 may comprise one or more grapple apertures 32. A grapple aperture 32 may comprise an opening or aperture which may be formed in or otherwise coupled to a grapple 11. Preferably, a grapple aperture 32 may be formed into the grapple body 30 so that the grapple aperture 32 may be generally distally located to a seat 13. The grapple 11 may be coupled to objects, such as a lifting bar, preferably via a securement fastener 16 which may be received in or otherwise coupled to a grapple aperture 32. A securement fastener 16 may comprise a strap, ring, or any other type of fastener which may be used to couple two objects together.

In some embodiments, the device 100 may comprise a catch 26 which may be configured to secure or maintain the ejector 14 in the first position 71 and/or configured to prevent the ejector 14 from moving into the second position 72. For example and as shown in FIG. 8, the catch 26 may be pivotally coupled to a portion of the grapple body 30 and portions of the catch 26 may be pivoted into contact with the ejector 14 to secure or maintain the ejector 14 in the first position 71. In preferred embodiments, a catch 26 may comprise an arm depression 26A, and portions of the arm 15 may be received in the arm depression 26A when the ejector 14 is in the first position 71 and the catch 26 is moved to contact and press the arm 15 against the ejector 14 so that the ejector 14 is pressed into the first position 71. Preferably, the catch 26 and the ejector 14 may be configured and shaped to work together to trap the retainer arm 15. This aids in positioning and moving about until such a time as weight is lifted to the exercise position. Once enough weight is added to fully seat the retainer arm 15, it disengages from the catch 26, allowing the catch 26 to retract. In further embodiments, the positioning of the catch 26 may be controlled by an actuator 27. An actuator 27 may comprise an electrically operated device, such as a solenoid, servo, comb drive, digital micromirror device, electric motor, electroactive polymer, piezoelectric actuator, servomechanism, thermal bimorph, screw jack, etc. In further embodiments, the positioning of the catch 26 may be spring actuated to hold the catch 26 in contact with the ejector 14 until the actuator 27 is activated to separate the catch 26 from the ejector 14. In further embodiments, the catch 26 may be configured to allow the construct to stay connected until the weight is hoisted, whether to hang from a barbell, or to simplify single use as for dips or pull-ups.

In some embodiments, the device 100 may comprise a positional sensor 28 which may be configured to detect the number of repetitions performed by a user of the device 100 by detecting changes in the positioning of the ejector 14 and/or by detecting movement of the ejector 14. A positional sensor 28 may comprise a detent switch, single pole switch, electric eye, Hall effect sensor, pressure switch, electrical circuit, a reed switch, a contact sensor, a button mount, an ambient light sensor, Capacitive transducer, Capacitive displacement sensor, Eddy-current sensor, Ultrasonic sensor, Grating sensor, Inductive non-contact position sensors, Laser Doppler Vibrometer (optical), Linear variable differential transformer (LVDT), Multi-axis displacement transducer, Photodiode array, Piezo-electric transducer (piezoelectric), Potentiometer, Proximity sensor (optical), Rotary encoder (angular), Seismic displacement pick-up, String potentiometer (also known as string pot., string encoder, cable position transducer), or any other suitable sensor.

In some embodiments, the device 100 may comprise a display 31 which may be configured to visually output information describing the device 100, such as the number of repetitions performed by a user of the device 100 as detected by a positional sensor 28. In further embodiments, a display 31 may comprise a light emitting device such as a light-emitting diode (LED). In still further embodiments, a display 31 may comprise a Liquid crystal display (LCD), Light-emitting diode display (LED), Electroluminescent display (ELD), Electronic paper, E Ink, Plasma display panel (PDP), Cathode ray tube display (CRT), High-Performance Addressing display (HPA), Thin-film transistor display (TFT), Organic light-emitting diode display (OLED), Surface-conduction electron-emitter display (SED), Laser TV, Carbon nanotubes, Quantum dot display, Interferometric modulator display (IMOD), and/or any other device or method which may be configured to provide visual information to a user.

Figure 3:
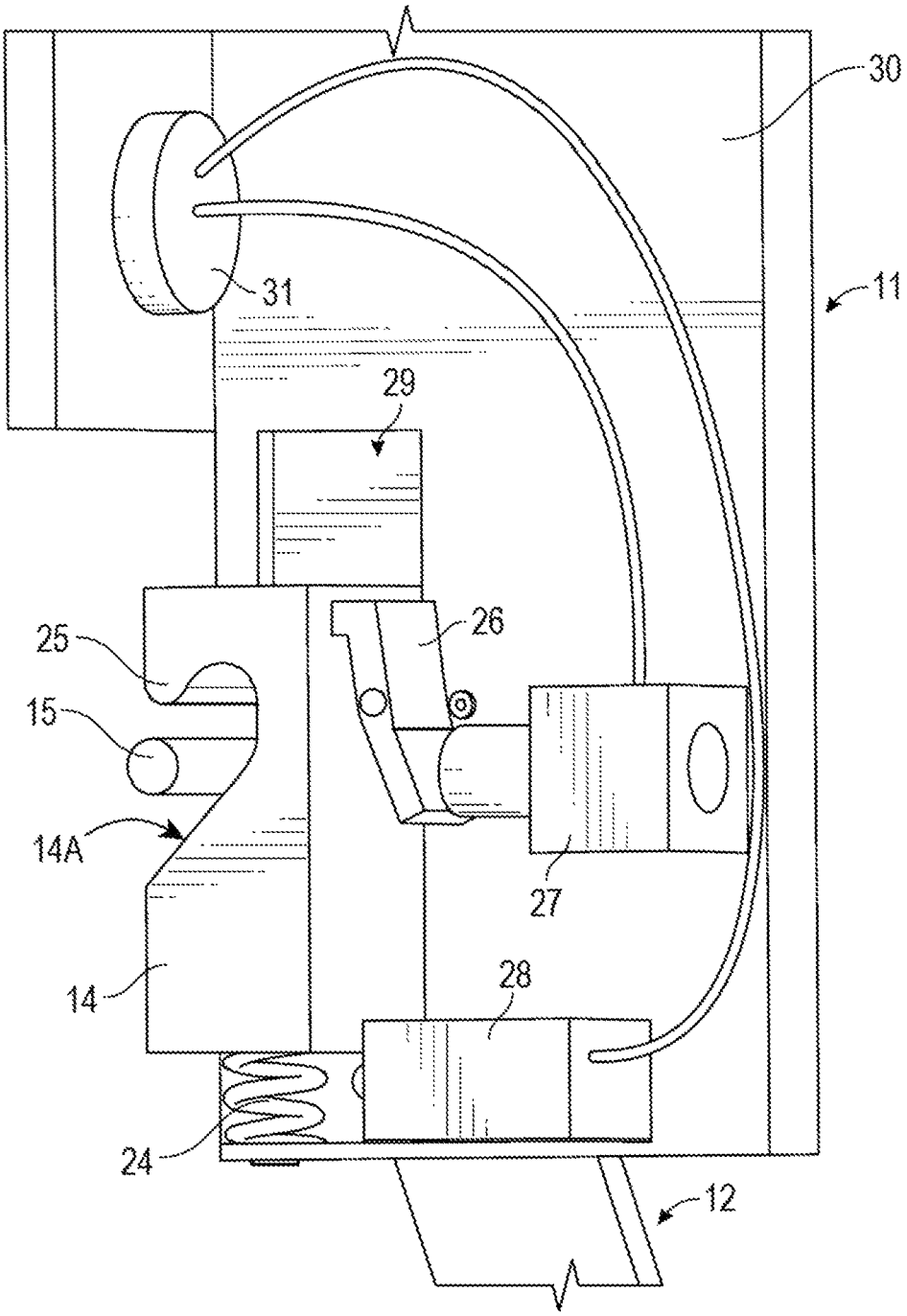
FIG. 3 shows a rear perspective internal view of an example of a grapple engaged to an arm of a retainer according to various embodiments described herein.
Figure 4:
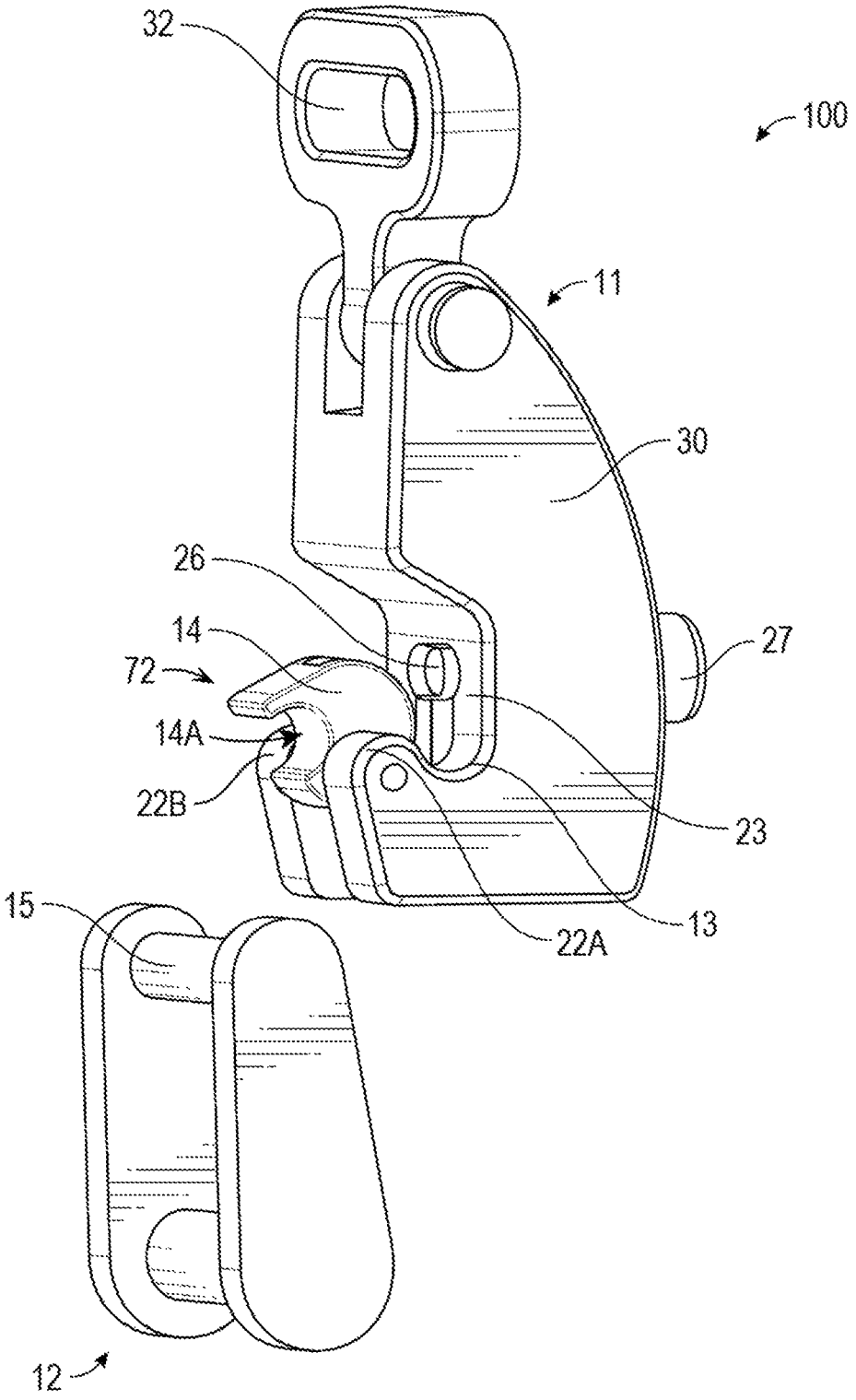
FIG. 4 depicts a perspective view of another example of a quick release weight retaining device according to various embodiments described herein.

In some embodiments, the device 100 may comprise one or more circuits, optionally integrally formed with or otherwise integrated with an actuator 27, positional sensor 28, and/or display 31, which may function as a control unit and which be configured to control one or more functions of the actuator 27, positional sensor 28, and/or display 31. In further embodiments, the device 100 can be a digital device that, in terms of hardware architecture, may optionally comprise a dedicated control unit 90 having one or more processors, I/O interfaces, radio modules, data stores, memory, and/or power sources. It should be appreciated by those of ordinary skill in the art that FIG. 3 depicts examples of a device 100 in an oversimplified manner, and a practical embodiment may include additional components or elements and suitably configured processing logic to support known or conventional operating features that are not described in detail herein.

Figure 5:
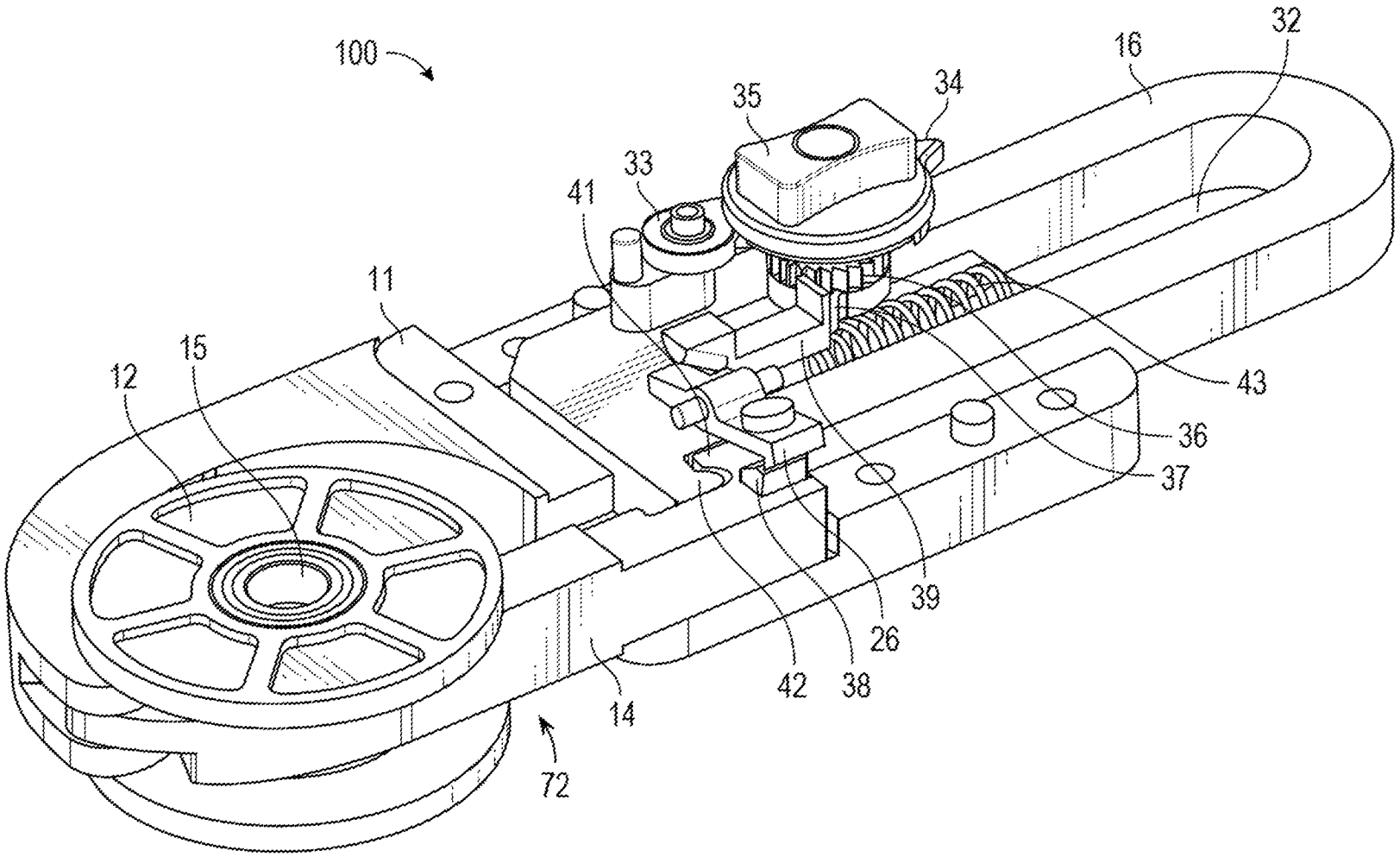
FIG. 5 depicts a partial perspective view of still another example of a quick release weight retaining device showing some exemplary internal components according to various embodiments described herein.

FIG. 5 depicts a partial perspective view of still another example of a quick release weight retaining device 100 showing some exemplary internal components according to various embodiments. In some embodiments, the device 100 may be configured to release an object or weight after a certain number of repetitions are performed by a user. The grapple 11 of the device 100 may be coupled to a weight lifting bar, optionally via a securement fastener 16, and the retainer 12 may be coupled to a weight or object, such as a weight plate, optionally via a weight saddle 18. The grapple 12 and retainer 11 may be coupled together. While the weight of the objects remains exerted on the device 100 the grapple 12 and retainer 11 may remain locked or coupled together. As the weight is relieved, the ejector 14 is opened by a spring or other tensioner that has enough force to overcome the weight of the objects. While in some embodiments and as shown in FIG. 5, the ejector 14 may be configured with a relatively straight shape, in alternative embodiments, the ejector 14 may be configured with a curved shape and the retainer 12 could comprise a simple loop or ring shape which may be combined to secure the arm 15 of the retainer 12.

In further embodiments, the device 100 may comprise a ratcheting mechanism that preferably may be housed in the grapple 11. In some embodiments, the retainer 12 may be secured between portions of the grapple body 30 and the ejector 14. The ejector 14 may be removably secured to the grapple 11 via the engagement between an ejector interlock 41 and a grapple interlock 42. The grapple interlock 42 may be movably coupled to the grapple 11, such as by being formed on a portion of the securement fastener 16 that may be movably coupled to the grapple body 30 via a float tensioner 43. Optionally, a catch 26 may be removably engaged to a catch receiver 38 which may comprise any topological feature which may be configured to prevent the ejector 14 from opening when there is no weight. For example, a catch receiver 38 may be alternatively configured as a recessed feature, such as a hole and catch 26 may be configured as a complementary shaped pin.

An optional transfer bar 39 may be configured to disengage the catch 26 from the catch receiver 38 upon being contacted or motivated by a zero actuator 37 on a ratcheting gear 36. Alternatively, a transfer bar 39 may not be needed in embodiments in which the zero actuator 37 and the catch 26 are positioned proximate to each other so that the zero actuator 37 may contact the catch 26 directly. The ratcheting gear 36 may be rotatably coupled to the grapple body 30 and operated by one or more working pawls 33 which in turn may be operated by reciprocating motion caused by the movement of the securement fastener 16 as the weight acting on the device 100 is alternatingly relieved from the device 100 by placing the weighted object and/or weight saddle 18 on a ground surface or other object, such as during the performance of exercise repetitions by a user. In this manner, the grapple 11 may comprise a ratcheting gear 36 which may be rotated by alternating application and removal of a weight to the grapple 11. For example, a working pawl 33 may be activated with weight applied to the device 100 and released with the decrease or absence of weight, thereby causing the working pawl 33 to engage the ratcheting gear 36 and to retract from it in order to rotate the ratcheting gear 36. One or more other working pawls 33 may be operably coupled to the ratcheting gear 36 and configured to function as a position keeper for the ratcheting gear 36.

Optionally, a control input 35, such as a knob or dial, may be coupled to the ratcheting gear 36 and may allow the user to control the position of the zero actuator 37 so as to set the number of reciprocating motions (caused by performing the exercise repetitions) that must be performed in order to release the retainer 12 from the grapple 11. Each reciprocating motion may ratchet the zero actuator 37 towards contacting the transfer bar 39, via the engagement of the working pawl(s) 33 and ratcheting gear 36, until the zero actuator 37 contacts the transfer bar 39 which in turn motivates the catch 26 to release the ejector 14. The control input 35 may include an indicator 34 which may allow the user to visually determine how may reciprocations (caused by exercise repetitions) are required before the ejector 14 will be released to release the retainer 11. The addition of the ratchet feature allows for the device 100 to remain in an "unopened" state, and stay in position for the latch to be secured as the weight is lifted for another repetition. Basically, a device 100 having a ratcheting mechanism may generally function with the same premise as the electronic version (best shown in FIG. 3), but the motion of the spring-loaded ratcheting mechanism coupled with the reciprocating motion caused by the weight being applied and relieved for the device 100 (caused by exercise repetitions) activates the ratchet mechanism.

While some exemplary shapes and sizes have been provided for elements of the device 100, it should be understood to one of ordinary skill in the art that the grapple 11, retainer 12, retainer body 17, weight saddle 18, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A quick release weight retaining device, the device comprising:

a. a grapple, the grapple having:

a seat positioned between a first front tooth and a rear wall, the first front tooth extending above the seat, an ejector having an ejector surface, the ejector surface movable between a first position and a second position; and b. a retainer, the retainer having:

an arm, wherein the arm is configured to rest on the seat when the ejector surface is in the first position, and wherein the arm is lifted above the first front tooth when the ejector surface is in the second position.

2. The device of claim 1, wherein the ejector surface is tensioned into the second position.

3. The device of claim 1, further comprising a second front tooth, wherein the ejector is movable between the first front tooth and the second front tooth.

4. The device of claim 1, further comprising a grapple aperture.

5. The device of claim 1, further comprising a weight saddle coupled to the retainer.

6. The device of claim 5, wherein the weight saddle is coupled to the retainer via a retainer body.

7. The device of claim 5, wherein the weight saddle comprises a sleeve coupled to a foot support surface.

8. The device of claim 1, wherein further comprising a positional sensor that is configured to detect movement of the ejector.

9. The device of claim 1, further comprising a ratcheting gear which is rotated by alternating application and removal of a weight to the grapple.

10. A quick release weight retaining device, the device comprising:

a. a grapple, the grapple having:

a seat positioned between a first front tooth and a rear wall, the first front tooth extending above the seat, an ejector having an ejector surface, the ejector surface movable between a first position and a second position, and a catch configured to prevent the ejector surface from moving into the second position; and b. a retainer, the retainer having:

an arm, wherein the arm is configured to rest on the seat when the ejector surface is in the first position, and wherein the arm is lifted above the first front tooth when the ejector surface is in the second position.

11. The device of claim 10, wherein the catch comprises an arm depression.

12. The device of claim 10, wherein the ejector surface is tensioned into the second position.

13. The device of claim 10, further comprising a second front tooth, wherein the ejector is movable between the first front tooth and the second front tooth.

14. The device of claim 10, further comprising a weight saddle coupled to the retainer.

15. The device of claim 14, wherein the weight saddle is coupled to the retainer via a retainer body.

16. The device of claim 14, wherein the weight saddle comprises a sleeve coupled to a foot support surface.

17. The device of claim 10, wherein the ejector surface is tensioned into the second position, and wherein the catch is configured to prevent the ejector surface from moving into the second position by the catch positioning the arm so that the arm presses against the ejector surface to maintain the ejector in the first position.

18. The device of claim 10, further comprising a grapple aperture.

19. The device of claim 10, wherein further comprising a positional sensor that is configured to detect movement of the ejector.

20. The device of claim 10, further comprising a ratcheting gear which is rotated by alternating application and removal of a weight to the grapple.

* * * * *